United States Patent [19]

Moshofsky et al.

[11] 4,122,819

[45] Oct. 31, 1978

[54] FUEL SUPPLY CONTROL AND CARBURETOR LINKAGE MECHANISM

[75] Inventors: Jerome F. Moshofsky, Portland; Allan J. Vanderzanden, Cornelius, both of Oreg.

[73] Assignee: Hyster Company, Portland, Oreg.

[21] Appl. No.: 725,514

[22] Filed: Sep. 22, 1976

[51] Int. Cl.[2] ..... F02B 77/08

[52] U.S. Cl. ..... 123/198 D; 123/198 DB; 123/DIG. 11

[58] Field of Search ..... 123/DIG. 11, 198 D, 123/198 DB, 97 B

[56] References Cited

U.S. PATENT DOCUMENTS

| | | | |
|---|---|---|---|
| 2,428,095 | 9/1947 | Reavis | 123/198 DC |
| 2,943,615 | 7/1960 | Kainz | 123/198 DC X |
| 3,379,187 | 4/1968 | Armbrust | 123/198 D |
| 3,487,183 | 12/1969 | Schulman | 123/198 DC X |
| 3,517,653 | 6/1970 | Ariga et al. | 123/198 DB |
| 3,626,919 | 12/1971 | MacMillan | 123/198 DB |
| 3,730,153 | 5/1973 | Harrison et al. | 123/DIG. 11 |
| 3,750,780 | 8/1973 | Danek | 123/198 D X |
| 3,792,696 | 2/1974 | Hollins | 123/198 DB |
| 3,898,973 | 8/1975 | Vidberg | 123/198 D X |

*Primary Examiner*—Ira S. Lazarus

*Attorney, Agent, or Firm*—Francis Swanson

[57] ABSTRACT

Apparatus for controlling fuel flow to an engine including means for disabling the operation of the accelerator pedal linkage associated with a carburetor is disclosed. The construction materially aids in preventing engine backfire. Included is a pivotable solenoid operated latch plate which forms part of an essential pivot point in the linkage arrangement and fixes the pivot point when current is flowing from the coil in engine ignition circuit.

Solenoid operated means for stopping fuel to the carburetor and closing the passageway from the carburetor into the intake manifold are also shown.

8 Claims, 3 Drawing Figures

FUEL SUPPLY CONTROL AND CARBURETOR LINKAGE MECHANISM

BACKGROUND OF THE INVENTION

1. Field of the Invention

This invention pertains to fuel control mechanisms in general and more particularly to those which have carburetor linkages that may be optionally rendered inoperative.

2. Description of the Prior Art

It is well known in the art to couple the accelerator pedal to an engine and carburetor through a series of mechanical links and cranks. Some incorporate devices for optionally fixing the linkage to provide for maintenance of constant vehicle speed or constant engine RPM. Other linkages include lost motion devices to accomplish proper timing of the opening and closing of certain carburetor components.

SUMMARY OF THE INVENTION

It is a principle object of the invention to provide a fuel control which includes a linkage arrangement to operatively couple the accelerator pedal to the carburetor in a manner so that the linkage may be selectively disabled.

A further object of the invention is to provide means for altering the pivot point of one of the linkage members when current in the engine ignition circuit is cut off.

A further object of the invention is to provide means for simultaneously shutting off fuel to the carburetor and for closing the carburetor butterfly valve in response to cut-off of power to the ignition coil.

Other objects and advantages of the invention will become apparent to those skilled in the art with reference to the accompanying drawings and detailed specification.

DETAILED DESCRIPTION

The apparatus to be described constitutes a means of controlling fuel flow to the engine when the engine ignition is shut off and includes apparatus for disabling the accelerator pump-accelerator pedal linkage arrangement. The arrangement effectively prevents the pumping of fuel into the intake manifold in the absence of ignition. This materially aids in preventing backfire.

Figure 1:
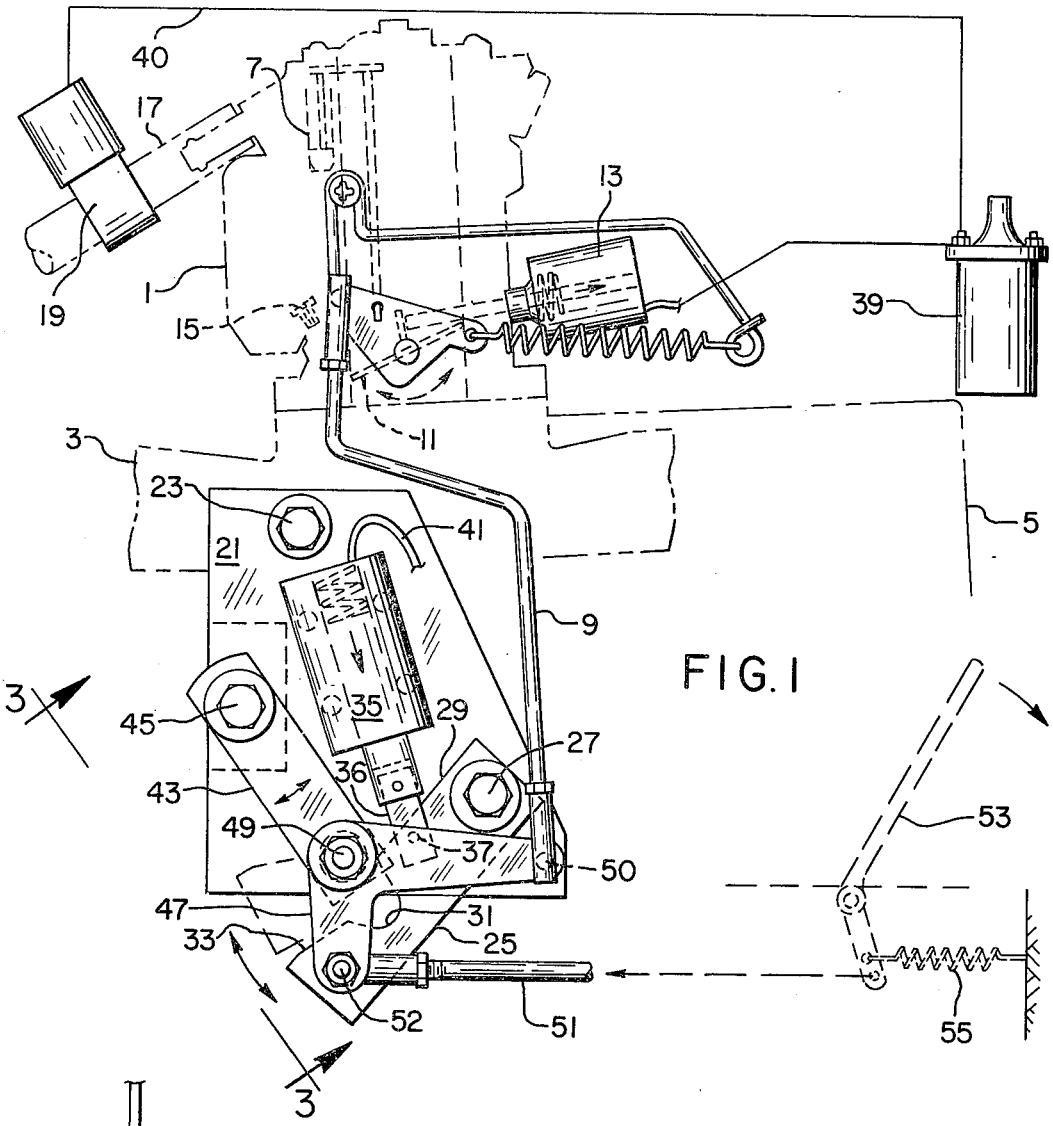
FIG. 1 is a side elevational view of the linkage mechanism and related structure.
Figure 3:
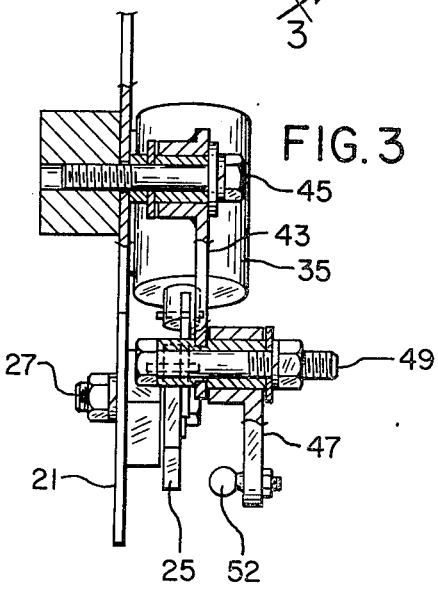
FIG. 3 is an elevational view taken along 3—3 of FIG. 1.
Figure 2:
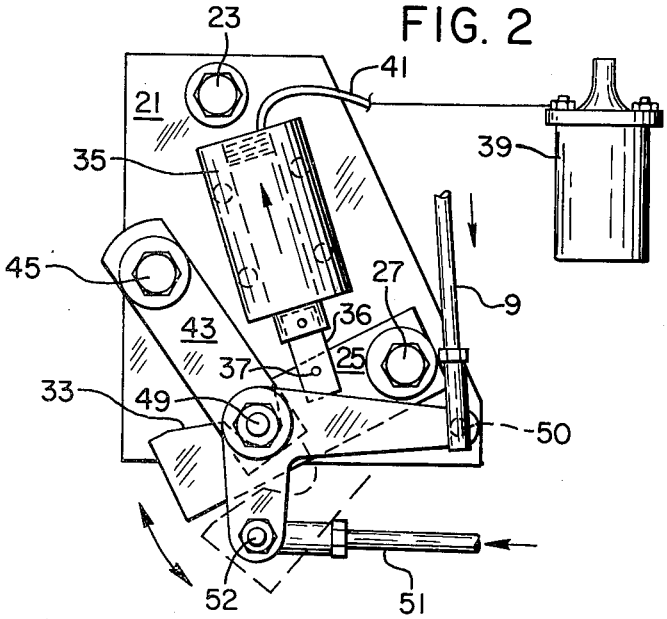
FIG. 2 is a side elevational view of the mounting plate showing the pivoting members and solenoid.

Referring now to the drawings, FIG. 1 shows a carburetor 1 mounted on the intake manifold 3 of engine 5. The construction of carburetor 1 includes an accelerator pump 7 which is connected by rod 9 to a linkage disabling mechanism to be described below. Also included in the carburetor 1 are butterfly valve 11, which is operated by solenoid 13, and jets 15. Interposed in fuel supply line 17 is a solenoid operated shut-off valve 19 which is connected to ignition coil 39 by wire 40.

The linkage disabling mechanism comprises a base plate 21 mounted on manifold 3 by bolt 23. A latch plate 25 is pivotally mounted on plate 21 by bolt-shaft 27. The upper edge 29 of latch plate 25 defines a curved groove 31 which terminates in a slanting lower portion 33 which acts as a cam. A latch plate solenoid 35 is mounted on plate 21 and has a moving element 36 which is pivotally attached to the latch plate 25 by pin 37. The solenoid 35 is also operatively connected to the engine ignition circuit through ignition coil 39 by a wire 41. The coil 39 controls the actuation of the solenoid 35 in a manner to be described below.

A swivel plate 43 is pivotally attached to base plate 21 at its upper end by bolt-shaft 45 and pivotally connected at its lower end to a crank 47 by bolt-shaft 49. In this embodiment, crank 47 is generally L-shaped and has two arms, the outer end of one arm is pivotally connected at point 50 to accelerator pump rod 9. The other arm has its outer end pivotally attached to accelerator pedal rod 51 at pivot point 52 which is in turn attached to an accelerator pedal 53 having a return spring 55; the pedal being manually adjustable by the operator's foot to regulate engine speed.

OPERATION

Assume now that the vehicle is operating. Fuel will flow into carburetor 1 through line 17 which contains the solenoid shut-off valve 19. Valve 19 is open because it is receiving electrical current through the engine ignition circuit from coil 39 through wire 40. Fuel will be mixed with air in carburetor 1 and will be fed through manifold 3 to engine 5 to be burned to produce power. With the engine 5 running, electrical power from coil 39 will pass through wire 41 energizing the latch plate solenoid 35. In this state, the moving element 36 of the solenoid 35 is retracted and latch plate 25 is pivoted upward. In this position, bolt-shaft 49 rests solidly in groove 31. This mode establishes a fixed pivot point about which crank 47 can pivot. As long as current from the ignition circuit through coil 39 is supplied to latch solenoid 35, latch plate 25 will remain drawn upward and together with swivel plate 43 and bolt-shaft 49 form this fixed pivot point for crank 47 to pivot about in response to pressure applied to accelerator pedal 53. Pressure on accelerator pedal 53 will act through rod 51 and cause crank 47 to pivot which in turn actuates the carburetor accelerator pump 7 through rod 9 increasing fuel flow into manifold 3.

However, if current in the engine ignition circuit if cut off, current from coil 39 to latch solenoid 35 is interrupted. This will cause the solenoid moving element 36 to extend downward, pivoting latch plate 25 away from swivel plate 43 and crank 47. Bolt-shaft 49 is now no longer supported by latch plate 25 within groove 31 and, lacking support, crank 47 and swivel plate 43 will swing down and away, pivoting about bolt-shaft 45. The pivot point of crank 49 is thus no longer fixed. Any pressure on accelerator pedal 53 will act through rod 51 and cause swivel plate 43 to pivot about bolt-shaft 45 while crank 47 pivots about bolt-shaft 49. Crank 47 is thus disabled as the position of bolt-shaft 49 no longer represents a fixed pivot point. It is readily seen that there is no vertical movement of accelerator pump rod 9 and the accelerator pump 7 is effectively blocked from pumping fuel from the carburetor 1 into manifold 3.

As current from the coil 39 to latch solenoid 35 ceases, the current to fuel shut-off solenoid valve 19 in fuel line 17 also ceases. The solenoid valve 19 will close and fuel will no longer flow to jets 15. Butterfly valve 11 will also close in response to the action of solenoid 13. Thus, all sources of fuel to the engine 5 are cut off and the accelerator pedal linkage operating the accelerator pump 7 is completely disabled. No fuel is available in the manifold 3 or engine 5 to cause backfiring.

As soon as ignition is resumed, current from coil 39 energizes solenoid 19 and fuel again flows to the jets 15. At the same time, the moving element 36 of latch plate solenoid 35 is drawn upward, causing latch plate 25 to pivot upward about bolt-shaft 27. The lower slanting edge 33 of plate 25 will contact bolt-shaft 49 and, acting as a cam, will cause it to slide forward and be guided into curved groove 31 in latch plate 25. Since bolt-shaft 49 is at the lower end of swivel plate 43, the plate will pivot into place about bolt-shaft 45.

With latch plate 25 fully raised and bolt-shaft 49 in groove 31, the pivot point of crank 47 as represented by bolt-shaft 49 is now again fixed and the pressure on accelerator pedal 53 will act through rod 51 and cause rotation of crank 47 which in turn produces movement of accelerator pump rod 9. This movement actuates the accelerator pump 7 forcing fuel into carburetor 1 and intake manifold 3.

Having disclosed our invention and described it in detail, it will be apparent to those skilled in the art that many modifications could be made to the invention without departing from its true spirit and scope. We claim as our invention, all such modifications as fall within the scope of the appended claims.

We claim:

1. A fuel supply control system for an engine comprising a movable crank mounted on the engine for actuating fuel supply increasing means on the engine;

and means responsive to engine ignition for selectively relocating the pivot point of the crank so that actuation of the supply increasing means through the crank is prevented.

2. A fuel supply control system for an engine having carburetor comprising:

a crank on the engine connected to a fuel control member on the carburetor and to an engine speed regulator;

and means for selectively moving the pivot point of the crank so that the crank moves between a first inoperative position and a second operative position in response to engine ignition turn-on relative to the carburetor and the fuel control member is rendered operable through the crank.

3. Apparatus according to claim 2 wherein the pivot point fixing means includes a latch member adapted to selectively engage the crank so that a fixed pivot point for the crank is established when the member engages the crank.

4. Apparatus according to claim 3 wherein the latch member defines a cam and a groove adapted to guide the crank from a first disabled position to a second operative position when the latch member engages the crank.

5. A fuel supply control system for an engine having a carburetor, the system comprising:

a link pivotally attached to the engine;

a crank pivotally attached to the link;

a first rod operatively connected to one end of the crank and to a fuel regulating member within the carburetor;

a second rod operatively connected to the other end of the crank and to an accelerator pedal;

and means for moving the pivot point of the crank so that the crank moves from a first operative position to a second inoperative position in response to shut-off of an engine ignition circuit and operation of the fuel regulating member by the first rod is blocked.

6. Apparatus according to claim 5 wherein the system includes a valve within a fuel supply line to the carburetor, the valve responsive to engine ignition shut-off to block fuel to the carburetor substantially simultaneous with closure of the carburetor fuel control valve.

7. A fuel supply control system for an engine having a carburetor, an ignition circuit and a fuel intake manifold, the system comprising:

a pivotable crank having a shaft and a plurality of arms, the crank mounted on a pivotable link operatively connected to the engine;

a first rod pivotally attached to one arm of the crank and to an accelerator pump on the carburetor;

a second rod pivotally attached to one arm of the crank and to an accelerator pedal;

a pivotable latch on the manifold adapted to selectively engage the shaft on the crank in response to ignition turn-on so that a pivot point of the crank is fixed by said engagement and the crank is rendered operable;

and means responsive to ignition circuit cut-off to block fuel flow from the carburetor into the intake manifold.

8. A fuel supply control system for an engine having a carburetor, the system comprising:

a closable carburetor fuel control valve on the carburetor;

a link pivotally attached to the engine;

a crank pivotally attached to the link;

a first rod operatively connected to one end of the crank and to a fuel regulating member within the carburetor;

a second rod operatively connected to the other end of the crank and to an accelerator pedal;

means for moving the pivot point of the crank so that the crank goes from a first operative position to a second inoperative position in response to shut-off of an engine ignition circuit and operation of the fuel regulating member by the first rod is blocked;

and a valve within a fuel supply line to the carburetor, the valve responsive to engine ignition shut-off to block fuel to the carburetor substantially simultaneous with closure of the carburetor fuel control valve.

* * * * *